US008745828B2

(12) United States Patent
Hanlon

(10) Patent No.: US 8,745,828 B2
(45) **Date of Patent: *Jun. 10, 2014**

(54) ELASTIC ATTACHMENT STRAP

(71) Applicant: Pull'r Holding Company, LLC, Elk Grove Village, IL (US)

(72) Inventor: Jared Hanlon, Santa Clara, CA (US)

(73) Assignee: Pull'r Holding Company, LLC, Schaumburg, IL (US)

( * ) Notice: Subject to any disclaimer, the term of this patent is extended or adjusted under 35 U.S.C. 154(b) by 33 days.

This patent is subject to a terminal disclaimer.

(21) Appl. No.: 13/766,032

(22) Filed: Feb. 13, 2013

(65) Prior Publication Data

US 2013/0219672 A1 Aug. 29, 2013

Related U.S. Application Data

(63) Continuation of application No. 12/559,479, filed on Sep. 14, 2009, now Pat. No. 8,397,354.

(60) Provisional application No. 61/096,388, filed on Sep. 12, 2008.

(51) Int. Cl.
*A44B 18/00* (2006.01)

(52) U.S. Cl.
USPC ..... 24/442; 24/306

(58) Field of Classification Search
USPC ..... 24/306, 442
See application file for complete search history.

(56) References Cited

U.S. PATENT DOCUMENTS

| | | | |
|---|---|---|---|
| 3,534,957 | A | 10/1970 | Norman et al. |
| 4,672,722 | A | 6/1987 | Malamed |
| 4,697,362 | A | 10/1987 | Wasserman |
| 5,243,991 | A | 9/1993 | Marks |
| 5,321,855 | A | 6/1994 | Ciuffo |
| 6,730,069 | B2 | 5/2004 | Tanzer et al. |
| 6,962,635 | B2 | 11/2005 | Tuman et al. |
| 7,032,278 | B2 | 4/2006 | Kurtz, Jr. |

*Primary Examiner* — Robert J Sandy

(74) *Attorney, Agent, or Firm* — Cherskov Flaynik & Gurda LLC

(57) ABSTRACT

An attachment strap created from an elastic strap capable of being stretched. The elastic strap is a continuous substrate forming a base of the attachment strap. A plurality of fastener sections attached to said strap, such that the fastener sections are spaced along the lengthwise direction of said strap and cross substantially the entire width of said strap. The fastener sections cross the width of the elastic strap at angles to the width of said strap. Also discussed is a method of manufacturing a flexible attachment strap which results in forming an elastic strap capable of being stretched. Per the method, a strap forms from a plurality of fastener sections having a fastener outer surface and a mounting inner surface and attaching said inner surfaces of fastener sections on said elastic strap. The mounted fastener sections form discrete fastening regions on the surface of the flexible attachment strap.

14 Claims, 1 Drawing Sheet

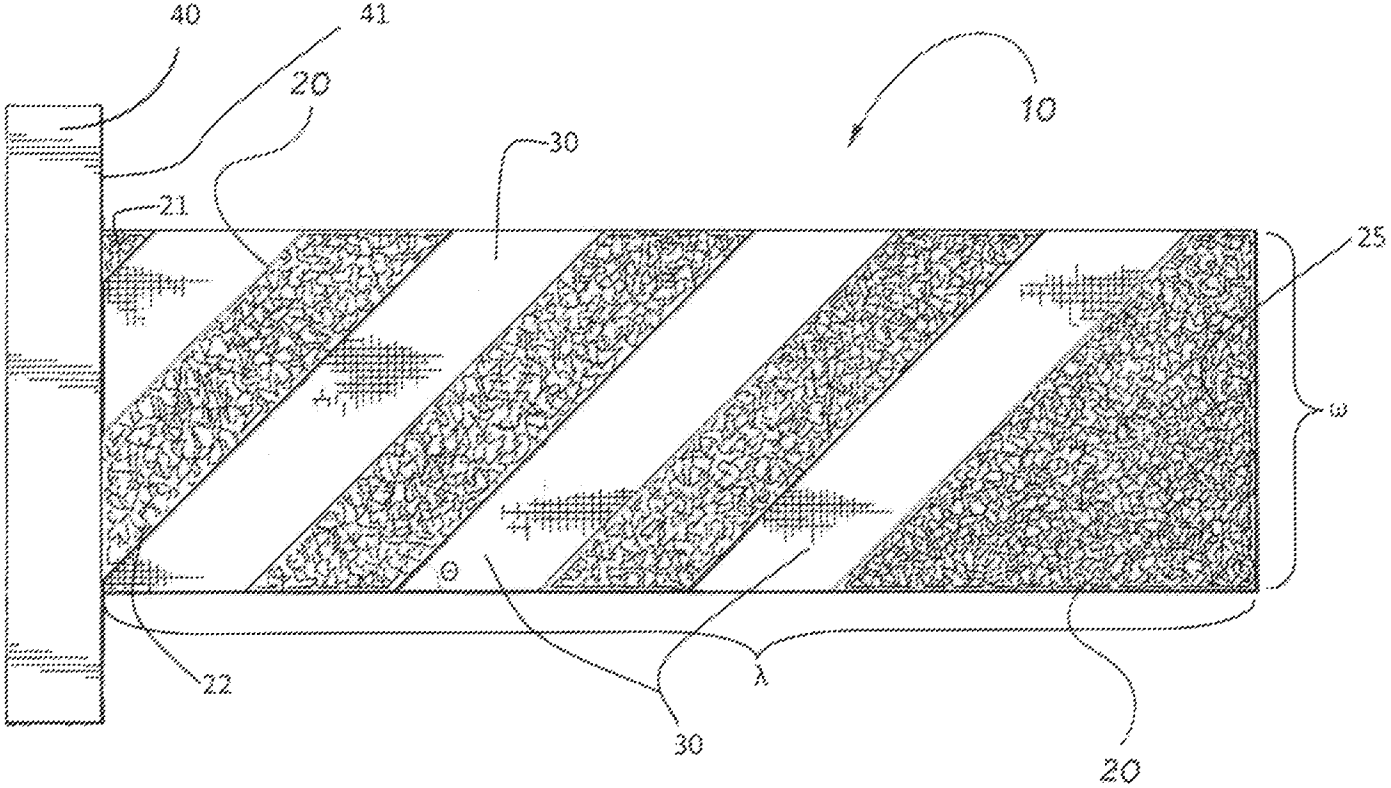
10
25
3
20
30
30
41
20
40
21
22

ELASTIC ATTACHMENT STRAP

CROSS REFERENCE TO RELATED APPLICATIONS

This utility application claims the benefit as a continuation of U.S. Utility application Ser. No. 12/559,479, filed on Sep. 14, 2009, now U.S. Pat. No. 8,397,354, which in turn claimed priority to U.S. Provisional Application No. 61/096,388 filed on Sep. 12, 2008, presently expired.

BACKGROUND OF THE INVENTION

1. Field of the Invention

The present invention relates generally to an elastic attachment strap, and, more particularly, to a means for fastening the ends of an elastic attachment strap.

2. Background of the Invention

A wide variety of products include a strap to attach the product to another device or to the end-user of the product. Such straps typically have loose ends that are connected together via an adjustable means so that the strap may be attached with the desired tightness. Such adjustable connection means may include, for example, sliding buckles, a series of snaps or buttons, or a Velcro-style hook-and-loop connection.

For many attachment strap applications, an elastic strap is desirable so that the strap can stretch when force is applied or when the implement held by the strap needs to be readjusted. For example, attachment straps for knee or elbow pads are typically elastic so that the strap can stretch with the bending of the elbow or knee. Many other attachment strap applications benefit from the use of an elastic strap.

One problem presented from the use of an elastic attachment strap is typically that the means used to connect the two ends of the attachment strap are not flexible. For example, if a Velcro-type loop and hook connection is used, the portion of the elastic strap containing the Velcro will not be able to stretch out and provide the desired flexibility.

The stretching of a Velcro-type loop and hook connection is fatal to the stability of the loop and hook fastener. As such, manufacturers of flexible straps use a minimal amount of Velcro for the connection. This limited quantity of Velcro stymies the adjustability of the strap inasmuch as only a small portion of each end may be used to hold the strap together.

One potential solution is to use short strips of Velcro spaced out along the length of elastic strap, so that some portions of the strap can stretch while the small Velcro strips do not stretch. This provides more adjustability in the strap tightness, but the Velcro connections tend to be weak in this design and pull apart easily when the elastic stretches during use.

Thus, it is clear there is an unmet need for an elastic attachment strap connection that is long enough to provide adequate tension adjustment, will not unduly inhibit the stretch of the elastic during use, and will remain connected while enduring such stretch.

SUMMARY OF INVENTION

An object of the invention is to provide a method and device for forming an adjustable strap that overcomes many of the disadvantages of the prior art.

Another object of the invention is to allow stretching of a flexible section of an adjustable strap while retaining a connection between inflexible sections. A feature of the invention is that the strip includes elastic regions integrally molded, and or contiguous with inelastic, connective regions. An advantage of the invention is that the elastic regions are adjusted without disturbing the connective regions. Another advantage is that the two regions, so integrated, form a construct, wherein at least one surface defines a generally flat, smooth topography which does not feature bulky fasteners or other connection means.

Still another object of the present invention is to provide a method and device to facilitate manufacturing of an elastic strap. A feature of the invention is that connective regions may be readily attached to pre-existing elastic members. An advantage of the present device is that the connective regions may be added to a pre-existing elastic strap.

Yet another object is to provide an elastic strap that allows for objects of any shape to be removably attached there to. A feature of an embodiment of the presently invented system is that the connective regions may be formed from any shape of material which facilitates removable connectivity. An advantage of the present system is that objects having any shape may be attached to the flexible strap.

Briefly described, in an exemplary embodiment, the elastic attachment strap of the present invention provides an improved connection means by utilizing strips of Velcro-type hook and loop fasteners that are spaced along the elastic strap at angles, rather than directly across the width of the strap. These spaced fastener strips allow for stretch around the connection area of the strap, while the angle of the strips provides more strength to the Velcro to resist separation when the elastic portion is stretched during use.

One embodiment of the invention comprises an attachment strap comprising an elastic strap capable of being stretched; and a plurality of fastener sections attached to said strap, such fastener sections being spaced along the lengthwise direction of said strap and crossing substantially the entire width of said strap; wherein, said fastener sections cross the width of the elastic strap at angles to the width of said strap.

Also provided is a method of manufacturing a flexible attachment strap comprising forming an elastic strap capable of being stretched; forming a plurality of fastener sections having a fastener outer surface and a mounting inner surface; and attaching said inner surfaces of fastener sections on said elastic strap; wherein mounted fastener sections form discrete fastening regions on the surface of the flexible attachment strap.

BRIEF DESCRIPTION OF DRAWING

The invention together with the above and other objects and advantages will be best understood from the following detailed description of the preferred embodiment of the invention shown in the accompanying drawings, wherein:

FIG. 1 is a plan view of an embodiment of the invention.

DETAILED DESCRIPTION OF THE INVENTION

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

In the form of the strap of the present disclosure chosen for purposes of illustration, FIG. 1 shows one portion of an elastic strap 10 embodying the present invention. Strap 10 includes multiple connective regions 20 that are used to connect ends of the strap 10 or to connect objects to the strap 10. Said connective regions 20 are interspaced with elastic regions 30.

In one embodiment, the connective regions 20 are added to a continuous substrate of elastic material forming connective regions 20 and elastic regions 30. In other embodiments, the connective regions 20 and elastic regions 30 comprise separate pieces that are connected together to form the strap 10.

In the embodiment shown in FIG. 1, the connective regions 20 comprise Velcro-type hook and loop fasteners, although any means of removable and repositionable fasteners may be used.

For example, depicted in FIG. 1 is one such object 40 connected to a first 21 connective region 20 and a second 22 connective region 20. The object 40 includes a strap-facing surface 41. Said strap facing surface 41 includes connective regions (not shown) which correspond to the first 21 connective region 20 and the second 22 connective region 20. FIG. 1 illustrates a particular advantage of the device which is a means for attaching an object to a plurality of anchor supports on a flexible substrate. This feature helps distribute the weight of the attached object to several anchor supports, thereby conferring added security to the object, simultaneous with optimizing the life cycle of each of the connective elements.

In one embodiment, fastener sections 20 shown in FIG. 1 comprise the loop portion of the Velcro-type connection. Accordingly, regions of the strap 10 are adapted to receive the strap-facing surface 41 of the object, such that the regions incorporates one element of a male-female connection means while the surface 41 defines the complement element of the same type of male-female connection means. This feature provides a means for allowing the object 40 to be removably attached to the connective regions 20.

In other embodiments, not shown, the connective regions 20 comprise other varieties of Velcro-type connectors. For instance, in one embodiment, an alternate type of Velcro, which relies solely on hook-containing surfaces, is used for the connective regions 20.

The elastic attachment strap 10 primarily stretches in the lengthwise direction A as the strap is connected at its ends. During use, strap 10 may also be stretched in the crosswise direction w, such that the cross wise direction is generally perpendicular to the lengthwise direction. The placement of the connective regions 20 is such that the connective regions extend at an angle to the longitudinal axis of the strap, such that the angle is more than 1 degrees and less than 90 degrees.

In one embodiment shown in FIG. 1, connective regions 20 are attached to elastic strap 10 at a connective angle θ with respect to the width of strap 10. This allows the elastic regions 30 of strap 10 in between fastener sections 20 to stretch while reducing the stress on the connective regions 20. As depicted in FIG. 1, the connective angle θ is approximately 45° from the line formed by the length of the strip 20. Resulting in connective regions forming stripes running at an angle with respect to the strip 10.

In other embodiments not shown, connective regions 20 were positioned straight across the width of strap 10, perpendicular to the length of same.

In further other embodiments, the connective regions 20 define a shape at its proximal end, the shape optimized to receive an object 40. For example, in one embodiment, connective regions 20 comprise circles. In still other embodiments, the connective regions 20 include rectangles, hexagons, or any number of polygonal structures. The shape of the connective regions 20 may therefore be selected to best match the shape of the item removably attached thereto.

The underlying substrate which forms the strap 10 may comprise any elastic material, such as fabric with elastic bands interwoven throughout. The strap 10 includes a surface area calculated by the multiplication of its length and width. In one embodiment, the connective regions 20 comprise approximately 50% of the total surface area of the strip. In turn, the elastic regions 30 comprise the remaining 50% of the total surface area. The ratio of connective regions 20 to flexible regions 30 is determined by the flexibility of the elastic regions 30. As the plasticity of the elastic regions 30 increases, the strap must include a larger percentage of connective regions than elastic regions.

Plasticity of the elastic regions is defined as the amount of extension that elastic regions are capable of providing. For instance, if one elastic region a1 is 10" wide in a relaxed state, but can be stretched to 12" in an extended state, and elastic region a2 is also 10" wide in a relaxed state, but can be stretched to 13" in an extended state, region a2 is considered more plastic than region a1.

Connective regions 20 may be attached to an underlying elastic strap 10 via any known method for attaching Velcro-type sections to fabric, such as by sewing the two parts together, permanent adhesive, melting, injection molding, and other techniques. The resulting bond between connective regions 20 and the strap 10 must be at least as strong as the bond between connective regions 20 and objects 40 removably connected to the connective regions 20.

In one preferred embodiment shown in FIG. 1, the final connective region 25 is angled on one side, but allowed to fill the entire end portion of the strap 10. This allows the end piece 25 to be used for a more firm connection, but such end portion is not essential to practicing the present invention.

In one embodiment, the invention consists of a method of manufacturing of an adjustable strap. The method consists of forming a flexible substrate into a strap, forming connective regions from a fastener material, and applying connective regions to the strap. The method may be adopted to any underlying substrate, regardless of the shape of same.

It is to be understood that the above description is intended to be illustrative, and not restrictive. For example, the above-described embodiments (and/or aspects thereof) may be used in combination with each other. Specifically, the connective regions 20 may be situated along only a portion of the length of one side only of the strap. Alternatively, connective regions may be confined to a portion of the length of both sides of the strap, such that the remaining lengths of each of the sides do not have connective regions. A distal most edge of this embodiment would feature a connective region similar to element 25 of FIG. 1. This embodiment will allow an object for securitization to be rolled up in frictional engagement only with the strap. As such, the object itself does not have connective surfaces to interact with the connective regions. Rather, this embodiment provides a means for the connective regions of one side to interact with complementary male-female connective regions of the other side.

In addition many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure The embodiment of the invention in which an exclusive property or privilege is claimed is defined as follows:

1. An attachment strap comprising:

an elastic strap capable of being stretched wherein said elastic strap comprises a continuous substrate forming a base of the attachment strap; and a plurality of fastener sections attached to said strap, such fastener sections being spaced along the lengthwise direction of said strap and crossing substantially the entire width of said strap;

wherein, said fastener sections cross the width of the elastic strap at angles to the width of said strap.

2. The attachment strap of claim 1 wherein said fastener sections comprise a hook and loop fastener.

3. The attachment strap of claim 2 wherein said fastener sections comprise the loop portion of hook and loop fastener.

4. The attachment strap of claim 1 wherein the angle at which said fastener sections cross the width of said elastic strap is between 20° and 70°.

5. The attachment strap of claim 1 wherein the fastener sections comprise 50 percent of the surface area of the elastic strap.

6. The attachment strap of claim 1 wherein the fastener sections are confined to one side of the elastic strap.

7. The attachment strap of claim 1 wherein the strap defines a first side and a second side and the fastener sections are confined to a proximal half of said first and second sides.

8. An attachment strap comprising:

an elastic strap capable of being stretched wherein said elastic strap comprises a continuous substrate forming a base of the attachment strap; and a plurality of fastener sections attached to said strap, such fastener sections being spaced along the lengthwise direction of said strap and crossing substantially the entire width of said strap;

wherein, said fastener sections comprise a polygonal shape.

9. The attachment strap of claim 8 wherein the shape of the fastener sections is adapted to receive a corresponding fastener on an object to be removably attached to said fastener sections.

10. A method of manufacturing a flexible attachment strap comprising:

forming an elastic strap capable of being stretched wherein said strap comprises a continuous substrate forming a base of the attachment strap;

forming a plurality of fastener sections having a fastener outer surface and a mounting inner surface; and attaching said inner surfaces of fastener sections on said elastic strap;

wherein mounted fastener sections form discrete fastening regions on the surface of the flexible attachment strap.

11. The method of manufacturing a flexible attachment strap of claim 10 wherein the attachment of inner surfaces of fastener sections results in stripes of fastener regions disposed on the elastic strap.

12. The method of manufacturing a flexible attachment strap of claim 10 wherein the attachment of inner surfaces of fastener sections results in polygons of fastener regions disposed on the elastic strap.

13. The method of manufacturing a flexible attachment strap of claim 10 wherein the attachment of inner surfaces of fastener sections results in elongated parallelograms of fastener regions disposed on the elastic strap.

14. The method of manufacturing a flexible attachment strap of claim 10 further comprising attaching an object to the fastener regions of the elastic strap.

* * * * *